US007081807B2

(12) United States Patent
Lai

(10) Patent No.: US 7,081,807 B2
(45) Date of Patent: Jul. 25, 2006

(54) AUTOMATIC PILL REMINDER BOTTLES

(76) Inventor: Joseph Lai, 950 Sampson Way, #108, San Pedro, CA (US) 90731

( * ) Notice: Subject to any disclaimer, the term of this patent is extended or adjusted under 35 U.S.C. 154(b) by 8 days.

(21) Appl. No.: 10/757,582

(22) Filed: Jan. 14, 2004

(65) Prior Publication Data

US 2005/0151625 A1 Jul. 14, 2005

(51) Int. Cl.
*G08B 1/00* (2006.01)

(52) U.S. Cl. ..... 340/309.7; 340/384.1; 368/109; 368/110

(58) Field of Classification Search ..... 340/384.1, 340/309.16, 573.1, 686, 692, 691, 693; 368/10, 368/109, 110; 221/2, 3
See application file for complete search history.

(56) References Cited

U.S. PATENT DOCUMENTS 4,347,804 A 9/1982 Villa-Real
4,367,955 A 1/1983 Ballew
4,419,016 A * 12/1983 Zoltan ..... 368/10
4,489,834 A 12/1984 Thackrey
4,572,403 A * 2/1986 Benaroya ..... 221/3
4,768,176 A 8/1988 Kehr et al.
4,964,683 A 10/1990 Sugarek et al.
5,009,338 A 4/1991 Barker
5,216,975 A 6/1993 Bartholomew
5,271,353 A 12/1993 Besthorne
5,358,117 A 10/1994 Adams
5,377,614 A 1/1995 Glazer
5,433,324 A 7/1995 Leonard
5,625,347 A * 4/1997 MacLean et al. ..... 340/568.1
5,751,661 A 5/1998 Walters
5,823,346 A 10/1998 Weiner
6,032,609 A 3/2000 Luoma
6,152,067 A 11/2000 Mathison
6,239,712 B1 * 5/2001 Hawk ..... 340/686.1
6,271,753 B1 * 8/2001 Shukla ..... 340/545.6
6,314,384 B1 11/2001 Goetz
6,529,446 B1 * 3/2003 de la Huerga ..... 368/10
6,604,650 B1 8/2003 Sagar
6,667,936 B1 * 12/2003 Ditzig ..... 368/10

OTHER PUBLICATIONS http://www.age-in-place.com/vialalarm.html.
http://www.nexdose.com/overview/.
http://supportplus.com/product_detail.cfm?STYLE=R192&Keycode=SEG25.
http://www.aardex.ch/MEMS4Mon.htm.
http://www.epill.com/bysku.html.
http://www.lifeclinic.com/focus/blood/supply_aids.asp.

* cited by examiner

*Primary Examiner*—Jeffery Hofsass
*Assistant Examiner*—Hoi Lau

(57) ABSTRACT

This present invention is for new user-friendly electronic pill reminder devices that convert regular conventional pill bottles to automatic reminder pill bottles. The reminder device is compatible and can be retrofitted inside a regular conventional pill bottle cap. This reminder device is installed inside the conventional pill bottle between the bottle cap and the bottle container. When the user closes the pill bottle cap on the bottle container, the electronic timer, with factory predetermined time interval, is automatically activated. That activated timer will generate alert signals not only remind user last pill has taken but also to remind the user to take his/hers next dose at time-out. The reminder device and alert signals are automatically deactivated and reset when the user opens the pill bottle cap (to take contents from the bottle container). This present reminder device works with both conventional safety (child-resistant) and non-safety pill bottle caps.

9 Claims, 4 Drawing Sheets

AUTOMATIC PILL REMINDER BOTTLES

FIELD OF THE INVENTION

The present invention is related to new retrofitted electronic devices to convert the conventional pill bottles into reminder bottles that help the users to remember to take their pills.

BACKGROUND OF THE INVENTION

1. The Problem

The conventional bottles are made of plastic, paper, glass or metal consist of bottle caps and bottle containers. Bottle containers may vary a lot but bottle caps are very much standard with have only a few popular sizes. Millions of conventional bottles contain non-food, food, food supplements or medications sold to consumers everyday. For most medical or health related applications, the contents (pills inside these bottles) have to be taken regularly. Keeping track of regularly doses of medications can be difficult. Skipping or over dosages of certain medications can be deadly. Unfortunately, these millions of sold (pill) bottles have no intelligence to notify or remind their owners to take the contents inside the bottles. Some other reminder devices do exist, but they are expensive to build, complicated to use, take extra shelve/drawer storage space to store and, most of all, those reminder devices are not compatible and cannot convert conventional bottles and conventional bottle caps into reminder bottles. There are needs for a user-friendly, simple, low-cost, effective and better way to "convert" these conventional dumb bottle caps into smart reminder bottle caps to remind users to take the contents inside these bottles.

2. The Solution

The present invention is directed to provide such a solution with an electronic reminder device with timer/controller circuits generate audible, motional, visual and wireless alerts inside the bottles. The present invention reminder device retrofitted inside the regular conventional bottle caps to remind users to take their next contents inside the bottle in a timely manner.

SUMMARY OF THE INVENTION

The present invention contains a reminder device to remind user to take pill regularly. The reminder device, as a retrofit kit, adds a small electronic circuit board to inside of the regular, conventional bottle cap of a pill bottle. This circuit board senses and detects the opening or closing of a pill bottle. The user or caretaker professional simply installs this reminder device, attached inside the bottle cap. When the bottle cap is closed, the timer circuit is "twisted-on" and activated at a predetermined dose time interval. The timing circuit is then counting down until time-out. At time-out, the electronic circuit generates audible, vibrating, visual and/or wireless alert signals for user to take the next pill. When the bottle cap is opened (removed), the electronics circuit senses and detects the opening of the bottle and deactivates and resets the timer circuit automatically.

The present invention reminder device with a circuit board is installed inside the conventional bottle cap with a sensor to detect the presence of pressures of the rim of the bottle container against the bottle cap when the bottle cap is closed to the bottle container.

Here is the summary of the uniqueness of present invention compare to the other prior art reminder devices:

1. The present invention reminder device requires no modification, nor new design of conventional pill bottle containers. This would save a lot of time and money for engineering, tooling, molding and manufacturing costs of a new bottle container.
2. The present invention reminder device does not require a new replacement, modification, or new design of conventional bottle cap, unlike the others. The conventional bottle cap works with the present invention reminder device. Again, this would save a lot of time and money for engineering, tooling, molding and manufacturing costs of a new bottle cap.
3. The present invention reminder device is compatible to both childproof and non-childproof type of bottle caps.
4. The present invention reminder device attaches nothing to outside of the conventional bottle container or bottle cap; no extra storage space is required to store the present invention reminder device and there is no visual impact to users. There is no appearance difference between conventional bottle and the present invention "converted" reminder bottle. This would help the conventional bottle users to get used to the new reminder bottle very quickly.
5. The present invention reminder device is environmentally sealed and protected inside the conventional pill bottle.
6. The present invention reminder device is a user-friendly device. Nothing for user to learn, no push-buttons to push, setup is not required and user does not have to realize the present invention reminder device is inside his/hers pill bottle. The present invention reminder device, inside the bottle cap, will simply remind users to take their next pill whenever the users close the bottle cap.
7. The present invention reminder device uses high precision, reliable modern electronic timer for controlling the reminder device.
8. The present invention reminder device generates wireless radio frequency (RF) alert signal to receivers outside the bottle, for generating stronger motion, louder sound, more visible alerts and useful for caretaker monitoring the user activity remotely.

DETAILED DESCRIPTION

The present invention consists of electronic components working as a timer/controller device inside the bottle cap, activated by closing the cap and deactivated by opening or removing the bottle cap.

Figure 1:
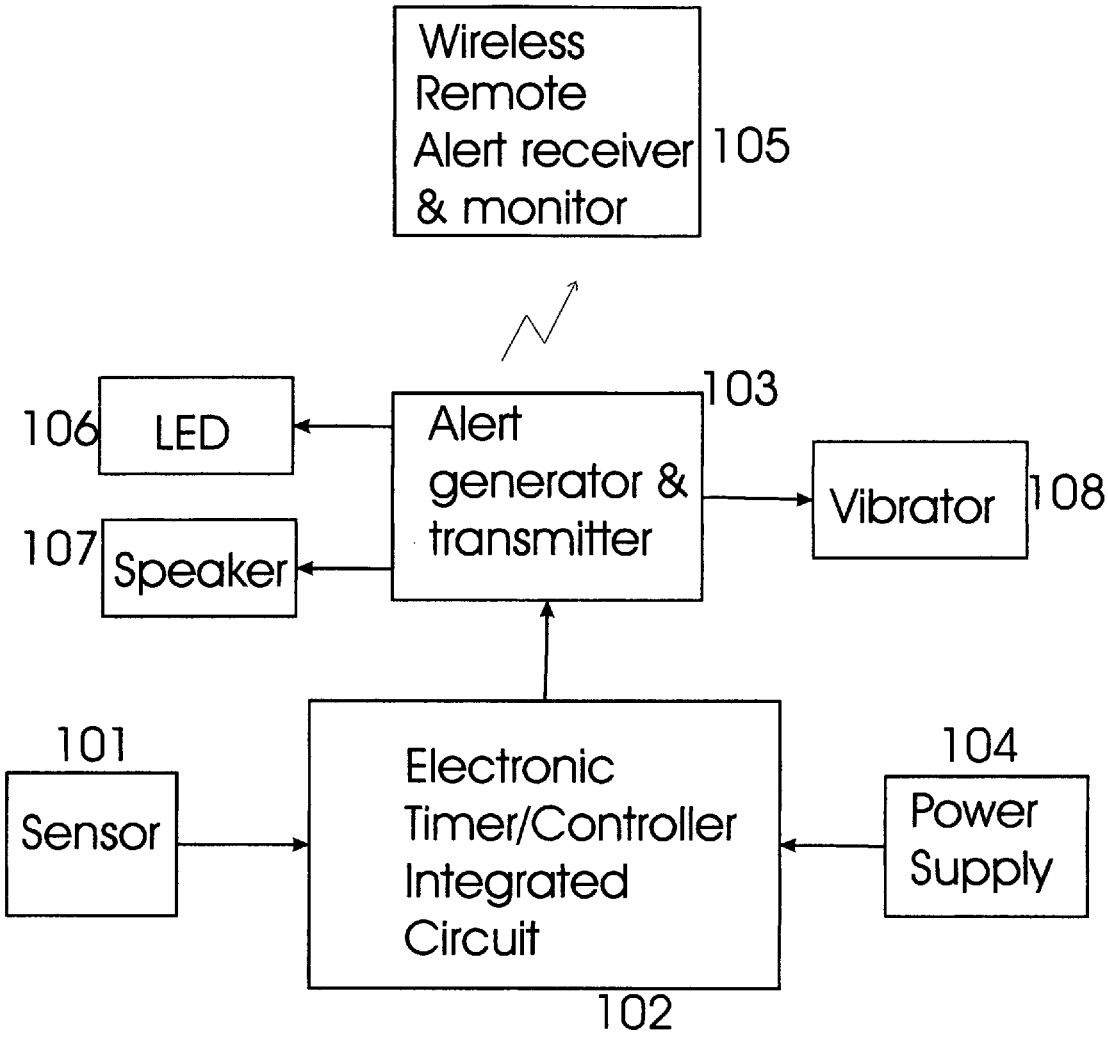
FIG. 1. Shows the circuit block diagram of the reminder device

FIG. 1 is the circuit block diagram of the reminder device. The reminder device has a pressure sensitive sensor (101) to sense the bottle cap is on or off. The power supply is a small battery to supply working voltage to the electronic timer/controller integrated circuits (102). When the sensor senses (101) closure of the bottle cap, it sends a signal to the electronic timer/controller IC (102), and then activates a timer circuit to count down until time-out. Time-out circuit triggers alarms to alert (103) the user with visual (LED) (106), audible (speaker) (107) and/or motional (vibrator) (108) signals to open the bottle and take medication. Also, notice wireless radio frequency signal is generated from transmitter (103) for remote alert and monitoring (105) applications.

Figure 2:
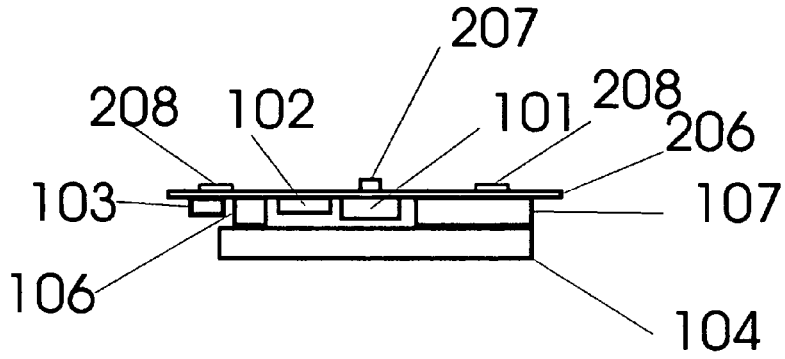
FIG. 2. Shows the design of the circuit board with sensor and other components to detect the open/close of the bottle cap FIG. 3. Shows the conventional bottle cap, the simplified circuit board with only the sensor and the conventional pill bottle container FIG. 4. Shows the sensor circuit detects the bottle cap has been opened with the reminder device deactivated FIG. 5. Shows the sensor circuit detects the bottle cap has been closed with the reminder device activated

FIG. 2 shows the physical components on the reminder device:

1. Printed Circuit (PC) Board

The printed circuit (PC) board (206) holds the electronic components and circuits for connecting components to components. Since this PC board is located inside the pill bottle, a non-toxic material, such as paper is recommend to be used as the base of the board. The PC Board in the present invention not only holds and connects the components but also serves as a sensing platform to detect the bottle cap has been opened or closed via the PC board's circular edge against the rim of the bottle container. The sensor (101) is mounted on the PC board to detect the presence of pressures from the edge of the PC board to the rim of the bottle container.

2. Battery

The power supply (104) contains battery to supply power to the electronic circuits. A long lasting, small coin size battery is recommended. Since the battery is located inside the pill bottle, non-toxic batteries with proper enclosure must be used to prevent problems, such as battery leakage.

3. Sensor

The sensor (101) contains mechanical momentary "push-button" switch mounted on the printed circuit board. A small circular hole is drilled on the PC board allows the push-button to go through the hole to the other side of the PC board. Sensor detects the signal when the bottle cap is closed to the bottle container. See FIGS. 4 and 5. When the bottle cap is pressed against the rim of the bottle container, the tip of the sensor (push-button) (207) is pressed down (ON) with pressure from the edge of the PC board. When the bottle cap is opened (removed) from the bottle container, the edge of the PC Board does not receive any pressure from the rim of the bottle container, therefore, the push-button switch is released and the timer is deactivated.

4. Alert Generator a. Audible alerts

A speaker (107) generates a beeping, atonal, music or voice sound to alert the user.

b. Visual alerts

Light emitting diodes (LED) (106) generate light signals to alert the user.

c. Motional alert

For blind or hard of hearing users, or in noisy environments, a vibrating motional alert (108) is recommended.

d. Wireless alert signal

Wireless alert signal generator (103) contains radio frequency (RF) transmitter, is used to trigger alert generators outside the reminder bottle for louder audible, more visible and stronger motional alerts. Wireless alert signal is also useful for caretaker, such as doctor or nurse, monitoring the user taking medication remotely.

5. Electronic Timer/Controller Integrated Circuit (102)

a. Low power digital electronic integrated circuit (IC chip)

b. Sensor input circuit c. Timer circuitry and function is set at a predetermined time interval.

d. Timer activated indicator, slow LED flashing on and off slowly, at every 10 seconds or longer is recommended for saving the battery.

e. Alert function, driver circuit for LED, vibrator, buzzer and wireless radio frequency (RF) transmitter.

6. Enclosure

The enclosure seals the electronic circuits from the contents inside the bottle in case of toxic contamination, and from the contents to the circuit board. A waterproof enclosure is required.

7. Adhesive to the Cap

The electronic circuit board is mounted onto the inner side of the bottle cap by using soft, elastic double side adhesive tape (208) so it will not fall off the bottle cap when the user opens the bottle to take medication, and won't hold down the sensor tip (207) when the bottle cap is opened from the bottle container.

Figure 3:
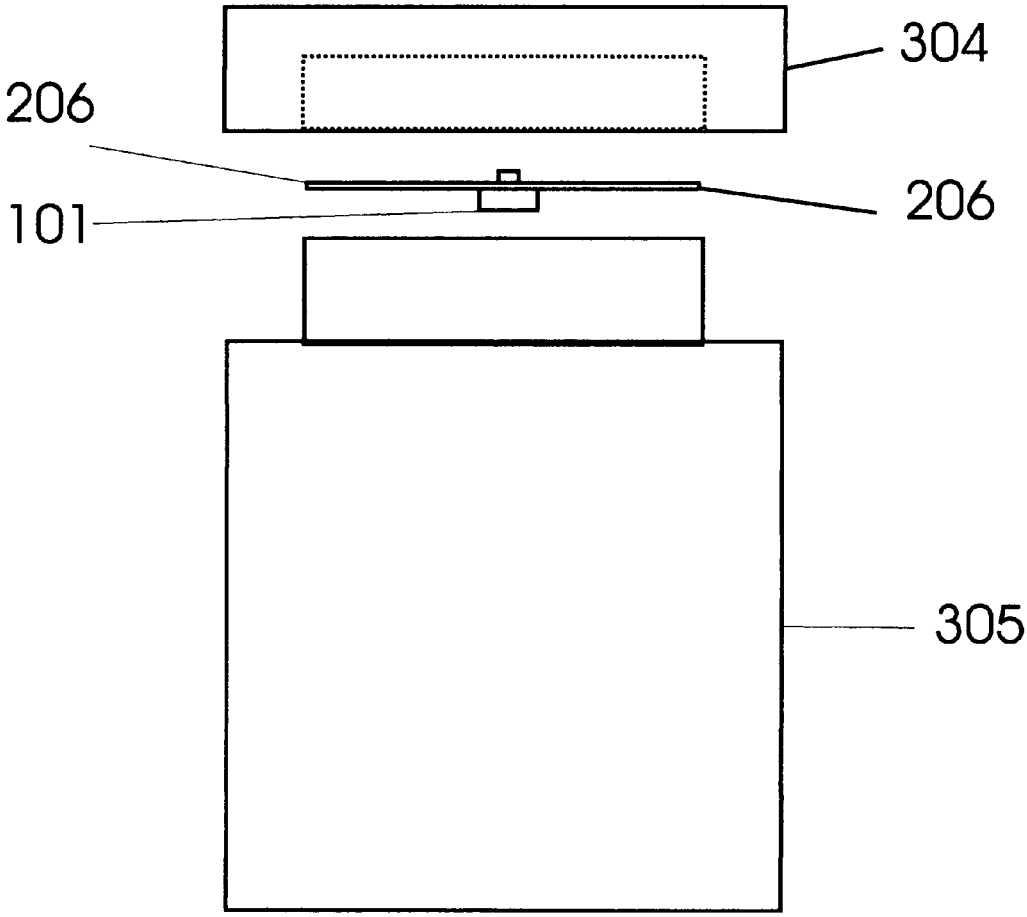

FIG. 3 shows the bottle cap (304), the simplified reminder device (206) with only the sensor and the bottle container (305). The reminder device (206) is a circular shaped disk about the same dimension as the rim of the bottle container (FIG. 4 401), allowing the reminder device to fit inside the bottle cap. By using the adhesive double-sided tape (FIG. 2 208), the reminder device is glued onto the inside of the bottle cap.

Figure 4:
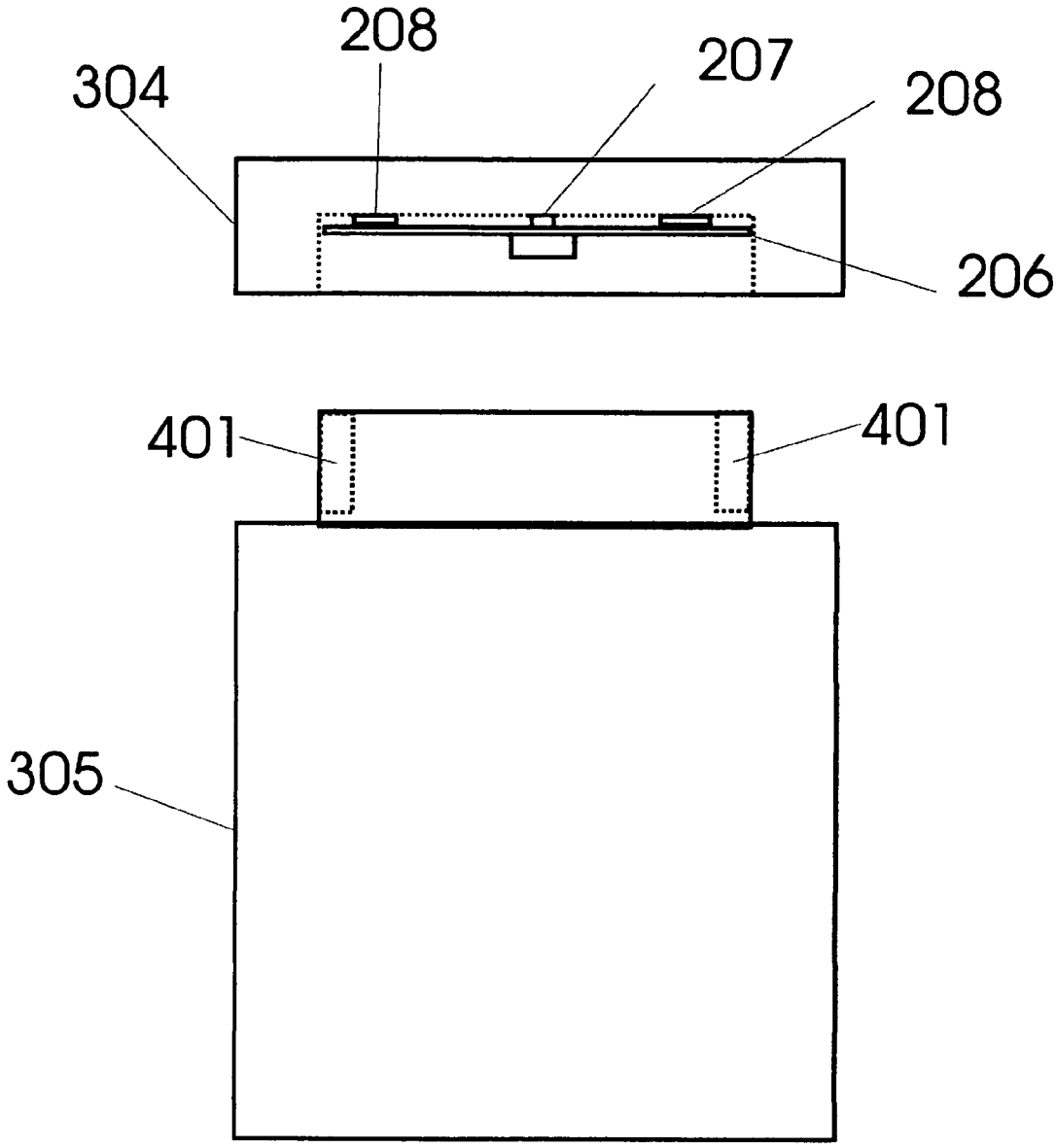

FIG. 4 shows the double adhesive tape (208) holding the reminder device (206). Notice the sensor is a spring-loaded push-button on/off switch. The push button tip (207) detects "no pressure", stands up freely when the bottle cap (304) is opened from the bottle container (305).

Figure 5:
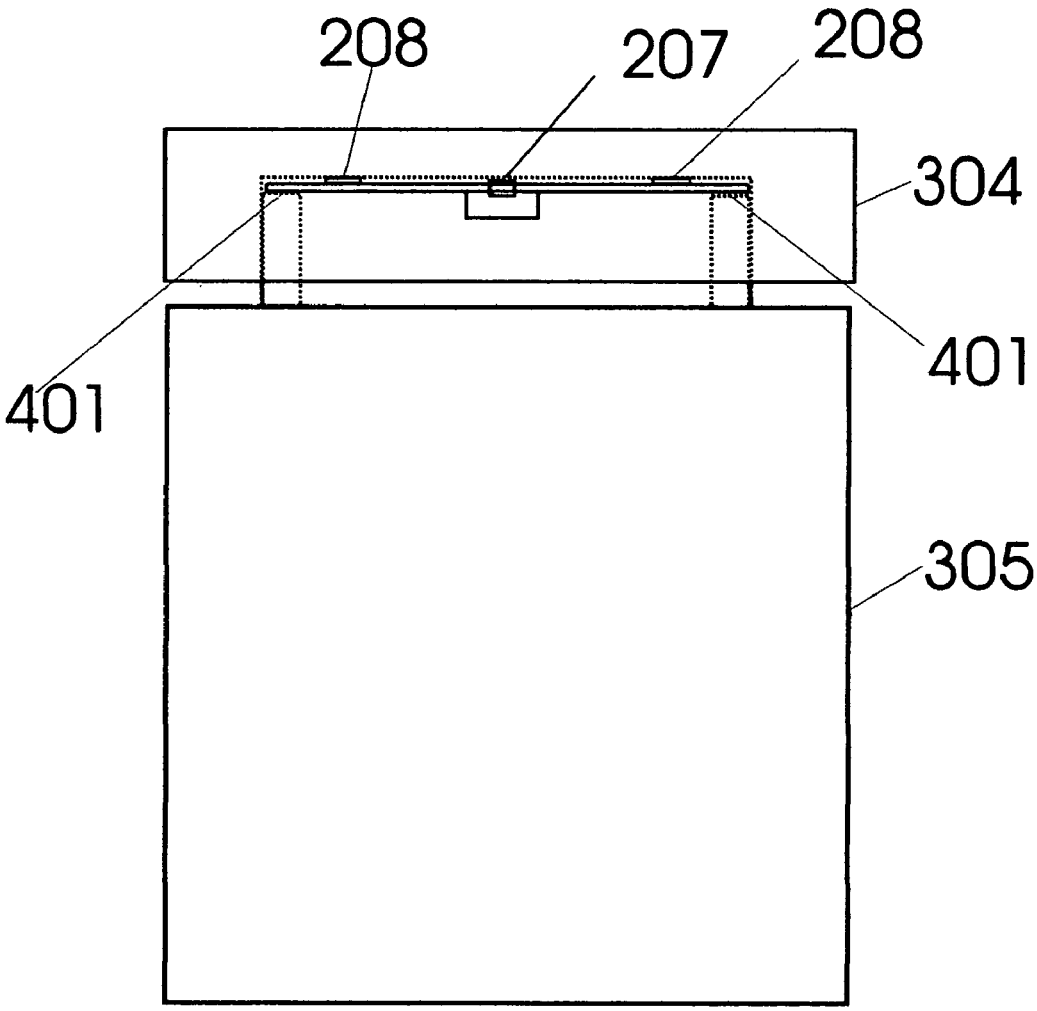

FIG. 5 shows the bottle cap (304) is closed to the bottle container as the rim (401) of the bottle container is pressed against the edge of the reminder device (206). The tip of the sensor (207) is pressed down and detected the pressure from the rim of the bottle container to the bottle cap and turns to the "on" position. The sensor detects bottle cap is closed and timer circuit (203) is activated.

I claim:

1. A new low-cost and user-friendly electronic reminder device retrofits inside a conventional pill bottle cap to convert a conventional pill bottle to an automatic pill reminder bottle, for helping user to remember to take the content stored inside said convention pill bottle regularly, comprising of:

a. a battery supplies the power to said electronic reminder device, b. a sensor that automatically senses and detects the closing or opening of said conventional pill bottle cap to activate or deactivate a timer, c. said timer is activated by said sensor at a factory predetermined time interval when said sensor detects said conventional pill bottle cap has been closed onto the said conventional pill bottle, d. alert means generate audible, visual, vibration and wireless signals to indicate said timer is timed-out or not to remind said user to open said conventional pill bottle cap, take or eat said content at time-out of said timer, and deactivate said timer automatically, and e. attachment means to hold said electronic reminder device onto the inside of said conventional pill bottle cap, Whereby said conventional pill bottle is converted to said automatic pill reminder bottle.

2. The electronic reminder device of claim 1, wherein said conventional pill bottle cap is a standard, regular, typical, child resistant or non-child resistant, off-the-shelf and over-the-counter lid at homes, offices or stores, enclose pills inside said conventional pill bottles.

3. The electronic reminder device of claim 1, wherein the content inside said conventional pill bottle are regularly prescribed or non-prescribed medications, food supplements or vitamin pills products.

4. The user-friendly electronic reminder device of claim 1, wherein said factory predetermined time interval is not required for said user to setup time interval settings contain four times, three times, twice, once daily and/or weekly interval of said alert.

5. The electronic reminder device of claim 1, wherein said retrofit is a method of adding and attaching said reminder device, as an aftermarket kit, to said conventional pill bottle cap without physically altering, changing or modifying said conventional pill bottle cap and said conventional pill bottle.

6. The electronic reminder device of claim 1, wherein said sensor contains a pressure sensitive push-button switch and detects pressures from the inside of said conventional pill bottle cap against the rim of said conventional pill bottle to determine whether said conventional pill bottle cap is closed or opened.

7. The electronic reminder device of claim 1, wherein said reminder device contains non-toxic materials or is hermetically sealed to protect from said reminder device contaminating said content inside said conventional pill bottle and vice versa.

8. The electronic reminder device of claim 1, wherein said alert means generate audible alerts contain beeping, melodies, music and pre-recoded voice sound signals.

9. The electronic reminder device of claim 1, wherein said wireless radio frequency signal is generated by a radio frequency (RF) transmitter sending said alert means signal wirelessly to receivers, outside of said reminder pill bottle, for generating external alerts and remote monitoring purposes.

* * * * *